US006352484B1

(12) United States Patent
Killion

(10) Patent No.: US 6,352,484 B1
(45) **Date of Patent: *Mar. 5, 2002**

(54) APPARATUS FOR SOCCER TRAINING

(75) Inventor: Darryl Killion, Irvine, CA (US)

(73) Assignee: DMD Sports, Inc., Del Rey Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/591,309

(22) Filed: Jun. 9, 2000

Related U.S. Application Data

(63) Continuation of application No. 09/073,903, filed on May 6, 1998, now Pat. No. 6,152,838.

(51) Int. Cl.[7] ..... A63B 69/00
(52) U.S. Cl. ..... 473/424; 273/331
(58) Field of Search ..... 473/424, 423, 473/217, 576; 273/331

(56) References Cited

U.S. PATENT DOCUMENTS 4,687,209 A 8/1987 Carey
5,280,843 A 1/1994 Vartija et al.
5,358,258 A 10/1994 Killiion
5,401,034 A 3/1995 Mallinger
5,411,461 A * 5/1995 Thomascik ..... 482/124
5,443,267 A 8/1995 Thorson
5,443,576 A 8/1995 Hauter
5,522,757 A 6/1996 Ostrowski
5,544,894 A 8/1996 Howard
5,566,949 A 10/1996 Gorden
5,586,760 A 12/1996 Hauter
5,591,089 A 1/1997 Huffines
5,611,532 A 3/1997 Forrest, Sr.
5,620,186 A 4/1997 Dudley
5,746,365 A * 5/1998 Scott ..... 224/676
6,152,838 A * 11/2000 Killon ..... 473/424

* cited by examiner

*Primary Examiner*—Jeanette Chapman
*Assistant Examiner*—M. Chambers
(74) *Attorney, Agent, or Firm*—Knobbe, Martens Olson & Bear, LLP

(57) ABSTRACT

A sports ball is held in a novel manner within a cradle having multiple arms encircling the ball and attached by Velcro® to a set of strips attached to a flexible tether line fastened to a person's waist. The ball is able to be kicked or punched and return to the striker in each cycle.

14 Claims, 3 Drawing Sheets

APPARATUS FOR SOCCER TRAINING

RELATED APPLICATION

This application is a continuation of U.S. patent application Ser. No. 09/073,903, now U.S. Pat. No. 6,152,838 filed on May 6, 1998.

BACKGROUND OF THE INVENTION

1. Field of the Invention

The invention is generally a sling and harness for attaching a ball to a sportsman and is specifically, a cradle with an elastic tether line for soccer trainer.

2. Description of Related Art

The following art defines the present state of this field:

Hauter, U.S. Pat. No. 5,586,760 describes a soccer training apparatus is provided. The apparatus has a mesh soccer net sized and configured for encapsulating a soccer ball and loosely holding the soccer ball within the mesh soccer net enabling the encapsulated soccer ball to freely rotate within. A waist belt has first and second belt ends adjustably connectable to one another for securement around a waist of a user. A cord has a first portion attached to the mesh soccer net and a second portion operatively connected to the waist belt leaving the mesh soccer net carrying the soccer ball suspended from the waist belt.

Mallinger, U.S. Pat. No. 5,401,034 describes a ball game recreational or training device comprises a cartridge adapted to be held in a user's hand. The cartridge houses a reel on which a tether such as a braided rope is wound. The free end of the tether emerges from the cartridge and a ball e.g. a soccer ball, is secured to it. A force applied to the ball, e.g. by kicking, causes the tether to unwind from the reel. The reel is spring-loaded for automatic rewinding of the tether. The cartridge is also provided with a thumb-actuatable button by which the flight of the ball away from the user may be arrested.

Hauter, U.S. Pat. No. 5,443,576 describes a soccer training apparatus is provided. The apparatus has a mesh soccer net sized for encapsulating a soccer ball. A cord having a first end and a securing portion is provided. The first end of the cord is attached to the mesh soccer net. A waist belt having an inner lapped belt end and an outer lapped belt end is also provided. Hook and loop fastening means provided on confronting faces of the inner lapped belt end and outer lapped belt end secure the inner lapped belt end and outer lapped belt end in detachable assembly together. The outer lapped belt end having an elongated slot of sufficient size to permit a soccer ball to be inserted through the elongated slot of the waist belt. An adjusting lock holds the securing portion of the cord to the inner lapped belt end leaving the mesh soccer net carrying the soccer ball suspended from the waist belt.

Vartija et al., U.S. Pat. No. 5,280,843 describes a game ball assembly for use with a game ball is described comprising a net for receiving and holding the game ball, a handle adapted to be retained within a user's hand, a length adjuster having a body part and a relatively movable locking slide part defining with said body part two paths at opposite sides of the slide part, and an elongated substantially inelastic tether cord or rope secured between the handle and the net. The tether extends through one of the paths of the length adjuster, through the net and then through the other path of the length adjuster such that a free end of the tether is supported between the slide part and the body part of the length adjuster. This arrangement facilitates simple adjustment of the length of the tether.

Ostrowski, U.S. Pat. No. 5,522,757 describes an inflatable recreational ball with an outer covering formed of a stretchable, flexible fabric material, which when fully expanded assumes a desired ball configuration, said covering having a small opening therein to permit the insertion into the outer covering of an inflatable balloon in its uninflated state. The balloon is formed of a thin elastic material having an air passage stem which projects through the opening, and which permits inflation of the balloon within the outer covering to cause the balloon on full inflation to engage the inner surface and to stretch slightly the outer covering to a desired generally spherical configuration. The ball includes a band or loop on the covering to secure an elastic element to the ball and preferably an elastic loop element is secured to the band and adapted to be held with the hand of a recreational ball user. In use, the repeated short movement of the hand of the user repeatedly bounces the recreational punch ball against the user's hand, utilizing the high bounce properties of the recreational punch ball and the elastic element secured to the ball.

Howard, U.S. Pat. No. 5,544,894 describes a device for simulating the recreational activity of a person "bungee jumping." The device includes a ball having exaggerated, abnormal facial features of a person on the outer surface, a pressure-activated audio sircuit inside the ball for producing a screaming sound when activated, a bungee cord attached at a first end to the ball, and a hand or wrist strap attached to the second end of the bungee cord. The device can also be used in a variety of tag or ball games.

Gorden, U.S. Pat. No. 5,566,949 describes a tethered ball game device is disclosed utilizing flat disk devices that are retrieved by the tethered ball or "snagger." The ball includes a magnet or hook and loop type fastener means and is therefore capable of attracting or attaching the flat disks or "caps." The tether is elastic in nature, thus allowing the snagger to be projected toward a group of caps, lying on the ground, attracting to one or more caps and then retrieving the caps, by virtue of the tether, in one continuous movement. A variety of games can be played utilizing the disclosed device in a manner that is far more challenging and creatively motivating than existing POG games or tethered ball games. The concept is simple enough that a child can master the level of coordination necessary to perform the tasks necessary to play the game yet the variations can be made complex enough that adults can find the games physically challenging. This stimulates hand to eye coordination in the users of all ages and skill levels and keeps the game interesting to players as they progress to more advanced levels of play.

Forrest, Sr., U.S. Pat. No. 5,611,532 describes a wiffle football is provided with a tether having a free end attachable to the user. The football is made of a generally rigid material, such as plastic, except that the tips are made of a resilient material designed to provide a cushioning effect and to absorb shock. The resilient tips prevent damage to the user and protect anyone in close proximity to the user.

Huffines, U.S. Pat. No. 5,591,089 describes an apparatus for use in training proper swing mechanics, for use in connection with golf, baseball, tennis, or similar sports. The device includes a sheath, which has an cushion member attached to a concave inner surface for user comfort. The apparatus is releasably attachable to a user's legs or hips by a pair of straps incorporating hook and loop fastening material and includes a projecting rigid support member extending normal to the sheath outer surface with a weigh member having a soft outer shell and suspended therefrom by a flexible cord; a clip device allows for adjustment of the cord length for suspending the weight member at a user selected position. The weight member includes access means for enabling user to add mass to, or subtract mass from, the suspended weight. The position and movement of the suspended weight member provides the user with feedback relative to numerous body positions and movements for teaching the user proper swing or body movement mechanics.

SUMMARY OF THE INVENTION

This invention relates generally to athletic training devices and, more particularly, describes a soccer training device for tethering a soccer ball to an individual.

In its simplest form, the apparatus for soccer training attaches a soccer ball to a user through a flexible tether line. A user attachment means attaches to the user, preferably by encircling the waist of the user as a belt, and attaches to one end of the elastic tether line. The other end of the tether line is attached to a ball holding means that encircles the soccer ball.

The benefit of this invention over the prior art is that this apparatus holds the ball firmly while, simultaneously, provide proper tactile feedback to the user when kicking the ball. The tether line results in relatively quick return of the soccer ball to the user after the ball has been kicked, and as such, builds quick reflexes and endurance through repeated use. The present invention can be used in many different ways for building different skills. For example, kicking the ball upward results in the tether line pulling the ball back into the ground for providing a large bounce. Repetition of this exercise trains the user to field incoming, bouncing balls. Other exercises can be used to training a user to spin the ball when kicking, controlling an incoming, spinning ball, alternately kicking the ball with each foot, and so forth. The present invention is a versatile training device that can be used by an individual at any time, not just during formal practice sessions. The user of such a device does not have to chase after a ball that has just been kicked, thereby allowing more practice of kicking the ball in any given period of time. Further, the present device is easily cleaned, relatively simple to manufacture, use, and maintain, and provides for training exercises never before possible. Other features and advantages of the present invention will become apparent from the following more detailed description.

BRIEF DESCRIPTION OF THE DRAWING

The accompanying drawings illustrate the present invention. In such drawings.

DETAILED DESCRIPTION OF THE INVENTION

Figure 1:
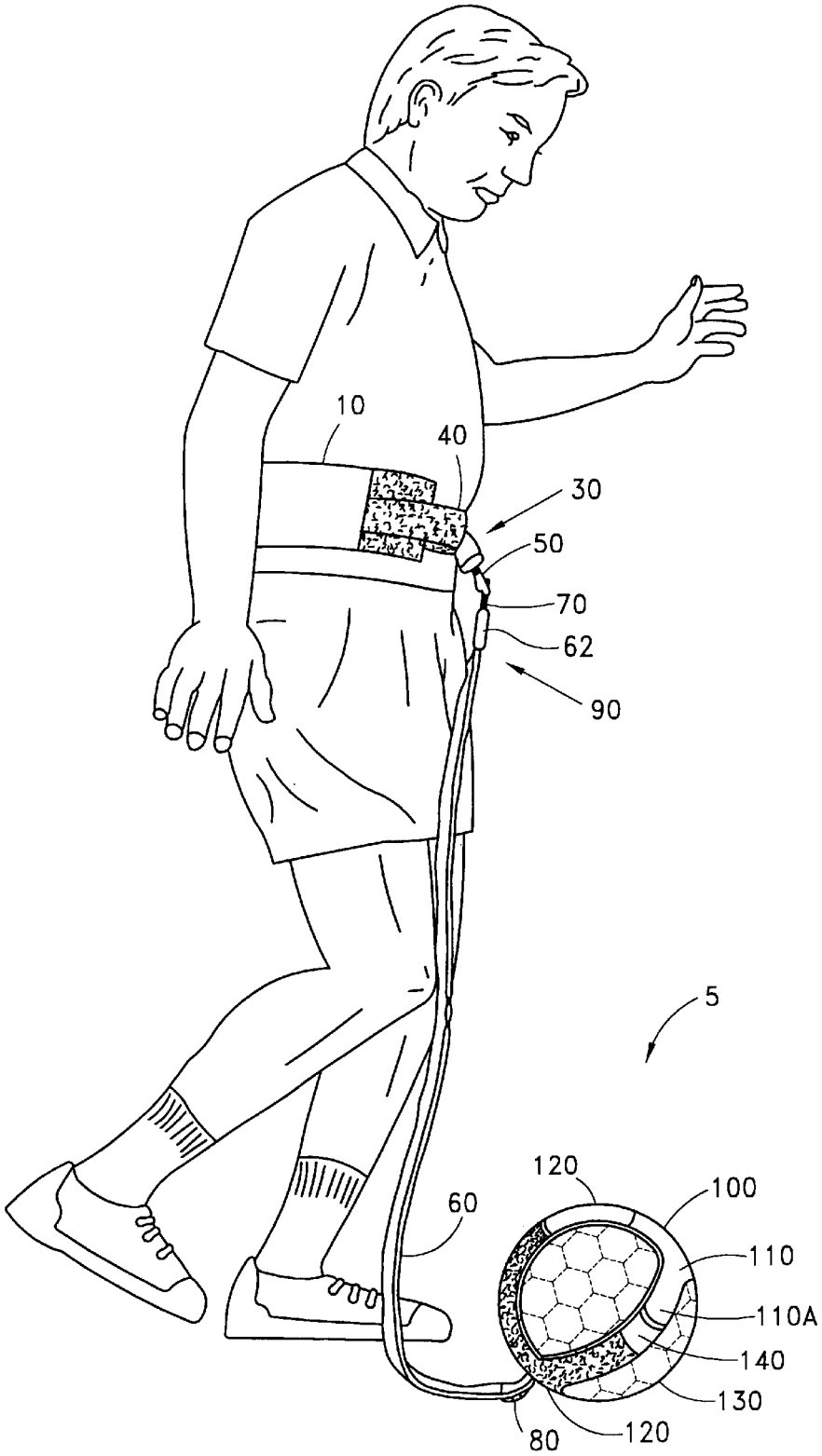
FIG. 1 is a perspective illustration of the invention, an apparatus for soccer training as attached to a user, the apparatus having a belt attached to a tether line which is attached to a ball holding means which encircles the ball with a ball cradle and four locking arms.

The above described drawing figures illustrate the invention, an apparatus for soccer training 5. As shown in FIG. 1, the apparatus consists of a user attachment means 10 attached to a ball holding means 100 by an elastic tether line 60.

As shown in FIG. 1, the user attachment means 10 is preferably a flexible belt that encircles a waist 30 of a user. The belt 10 preferably is made of neoprene to provide flexibility and some elasticity. The belt 10 preferably includes a fixing means 40, such as a hook and loop type fastener, for fixing the belt 10 to the user. Such a fixing means 40, in conjunction with the neoprene material, is adjustable so as to accommodate and snugly adapt to a variety of waist sizes. A first attachment means 50, preferably a spring-loaded clip, extends from the belt 10 away from the user.

As shown in FIG. 1, a tether line 60 is made of an elastic material that lengthens under tensile forces on the line 60, and thereafter contracts due to elastic resilience of the material. The line 60 is preferably a flat braided elastic cord that stretches out approximately 200%. The line 60 includes a second attachment means 70 and a third attachment means 80 fixed at opposing ends of the line 60. The second attachment means 70 cooperates with the first attachment means 50 of the belt. For example, in the embodiment wherein the first attachment means 50 is a spring-loaded clip, the second attachment means 70 is a plastic loop that engages the spring-loaded clip. The spring-loaded clip 50 allows the user to easily attach and remove the line 60 from the belt 10. The spring-loaded clip 50 is preferably swivel-mounted to prevent the tether line 60 from becoming twisted during use. Clearly, other alternate cooperative attachment means 50, 70 may be readily used by those skilled in the art. Further, the tether line 60 preferably includes a length adjustment means 62, such as a triglide buckle arrangement that allows the tether line 60 to be set at various lengths, preferably between 3–6 feet in length, depending on the skills being developed.

Figure 2:
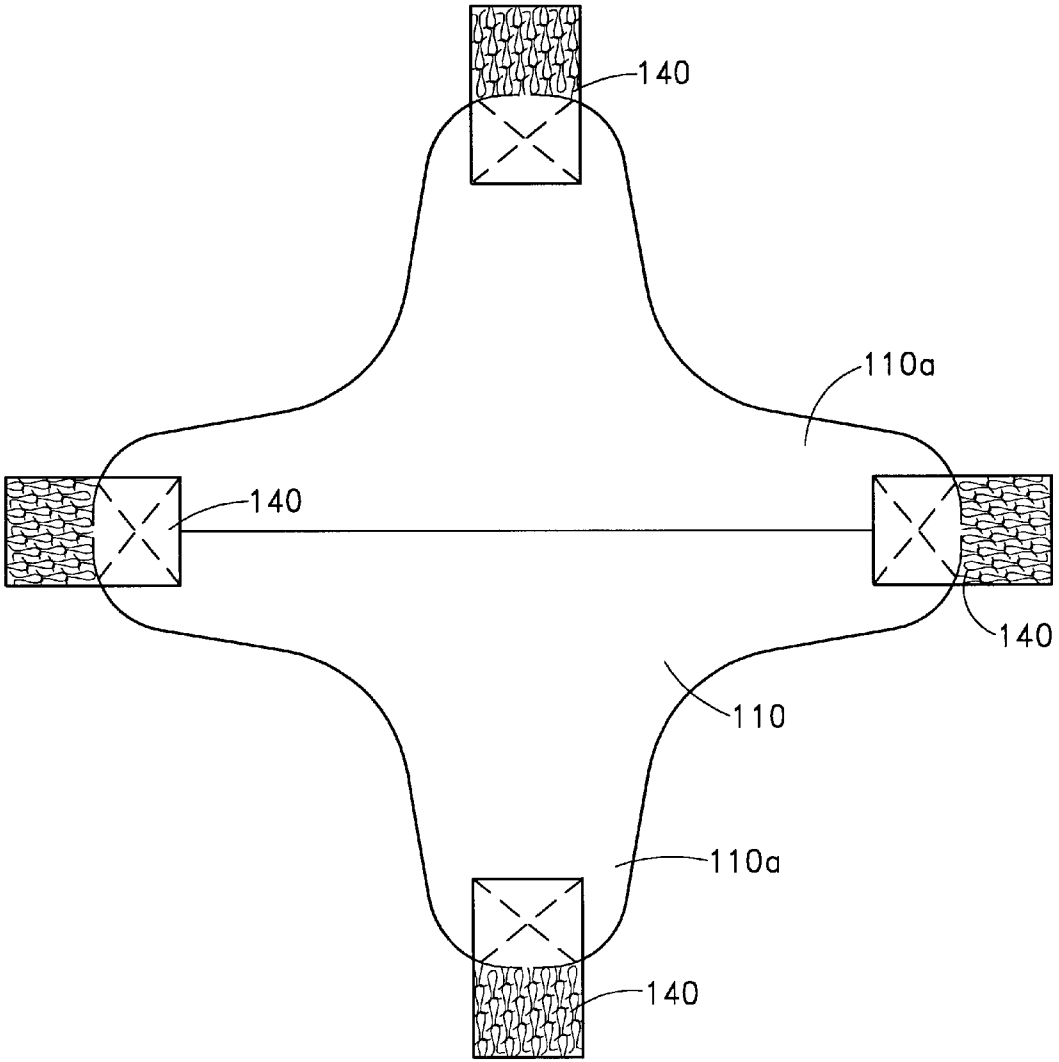
FIG. 2 is a plan view of the ball cradle.
Figure 3:
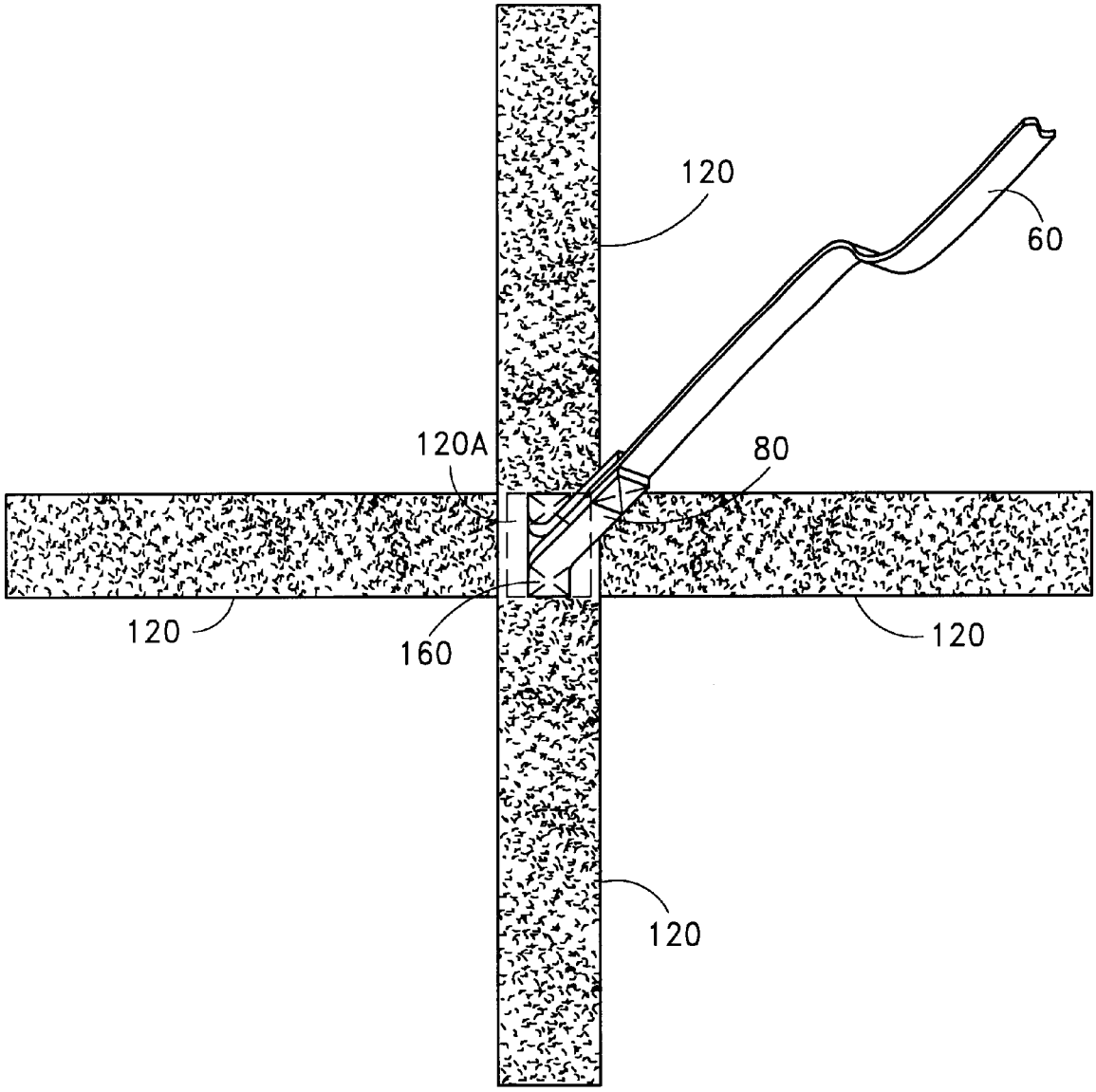
FIG. 3 is a plan view of the four locking arms and a portion of the tether line.

A ball holding means 100 is preferably made of a ball cradle 110, shown in FIG. 2, that engages a plurality of locking arms 120, shown in FIG. 3, to completely encircle the ball 130 so as to secure the ball 130 within the combination of the ball cradle 110 and the locking arms 120. As shown in FIG. 2, the ball cradle 110 has at least three, and preferably four, cradle arms 110A. The ball cradle 110 and the cradle arms 110A are preferably made of neoprene to provide flexibility and some limited elasticity. It is important that the ball cradle 110 is made of a single piece of material without any holes in the material. This allows the ball cradle 110 and the cradle arms 110A to snugly fit partially around the ball 130, but the material is not elastic enough to allow the ball 130 to slip out of the ball cradle 110. Each of the cradle arms 110A is attached to, and terminates at, a fastening means 140. The fastening means 140 is preferably a hook type fastener material which is flexible but inelastic, the material being sewn onto each of the cradle arms 110A. In its preferred embodiment, four locking arms 120 which match the four cradle arms 110A are formed by crossing two strips of a loop type fastener material and fixing the strips in place by sewing them securely together at their overlap portion 120A. The ball cradle 110 is wrapped around the ball 130 and the hook type fastener material of each of the fastening means 140 removable engages its complimentary locking arm 120, snugly locking the ball 130 between the ball cradle 110 and the locking arms 120. The shape of the ball holding means 100 improves the holding power of the apparatus for soccer training 5. Since the locking arms 120 only cover a portion of the ball 130, most of the ball 130 is left exposed for the user to kick. Furthermore, since the locking arms 120 are inelastic and the ball cradle 110 is of only limited elasticity, it is very difficult for the ball 130 to slip out from between the ball cradle 110 and the locking arms 120.

As shown in FIG. 3, a fourth attachment means 160 extends away from the locking arms 120. The fourth attachment means 160 is preferably a strip of 3 inch webbing material sewn in two places to the overlap portion 120A, forming a loop. The third attachment means 80 is preferably a loop formed by sewing the line 60 opposite the second attachment means 70 to another portion of the line 60. By passing the line 60 through both the third and fourth attachment means 80 and 160, a slip knot is formed which removably attaches the line 60 to the four locking arms 120. In another embodiment, the line 60 is simply sewn directly to the overlap portion 120A. The specific nature of this connection is not critical to the inventive nature of this invention, and those skilled in the art could devise many other attachment means equivalent to this invention.

In use, as shown in FIG. 1, the first attachment means 50 of the belt 10 is attached to the second attachment means 70 of the tether line 60, and the third attachment means 80 of the tether line 60 is attached to the fourth attachment means 160 of the girdle 100. The belt 10 is fixed around the waist 30 of the user. The ball 130 is positioned in front of the user for receiving kicking blows by the user, whereupon the ball 120 is propelled away from the user. Since the ball cradle 110 and the four locking arms 120 only cover a relatively small portion of the surface of the ball 130, the ball's surface usually receives the kicking blows rather than the invention, providing the user a more realistic tactile feedback when kicking the ball 130. The belt 10 and the fixing means 40 are strong enough to transmit the tension in the tether line 60 to the waist 30 of the user without stretching or breaking. The natural resiliency of the tether line 60 returns the ball 130 to the front of the user in each case for cyclic, repetitive practice in kicking the ball 130 by the user.

The connection between the ball cradle 110 and the four locking arms 120 can easily be adjusted to form a ball holding means 100 to securely hold a ball 130 of a wide range of sizes and shapes. The present invention, while having been described for use with a soccer ball and for providing training for skills associated with the game of soccer, may certainly be readily adapted to other sports by those skilled in the art. Such other sports might include tennis or other racquet sports, volleyball, American football, and the like. Clearly, many types of sports require endurance and quick reflexes, and the present invention is particularly well suited for training in these areas. The present invention can be readily adapted for use with many other types of physically manipulated sporting equipment, such as volleyballs, tennis balls, footballs, badminton birdies, and the like.

While the invention has been described with reference to at least one preferred embodiment, it is to be clearly understood by those skilled in the art that the invention is not limited thereto. The scope of this invention includes all structures equivalent to the preferred embodiments described in this specification.

What is claimed is:

1. A sports training apparatus, comprising:

a flexible belt with first and second ends adapted to encircle a waist of a user, said first and second ends including belt fasteners to removably secure said ends together;

an elastic tether line extending from said belt to a ball holder;

said ball holder comprising a ball cradle portion and a locking arm portion;

said ball cradle portion comprising at least four cradle arms made from a continuous piece of material, each cradle arm having a first edge, a second edge, an end where said first and second edges meet, and a centerline, said first edge of each arm beginning at said end of said cradle arm and extending curvilinearly away from said centerline of said arm, transitioning into a second edge of an adjacent arm, whereby a substantial surface area is provided between the intersection of the centerlines of each adjacent pair of arms and said transition of said first and second edges of said adjacent cradle arms; and said locking arm portion comprising at least four locking arms with first and second ends, each of said first ends of said locking arms being attached to each other, and each of said second ends being removably attachable to a corresponding end of one of said cradle arms.

2. The sports training apparatus of claim 1, wherein said ball holder is adjustable so as to accommodate and snugly adapt to a variety of ball sizes.

3. The sports training apparatus of claim 1, wherein said tether line is made of an elastic material that lengthens under tensile forces on the line and thereafter contracts due to elastic resilience.

4. The sports training apparatus of claim 1, wherein said tether line is a flat braided elastic cord that stretches out at least about 200% in length.

5. The sports training apparatus of claim 1, wherein said belt is made of neoprene material.

6. The sports training apparatus of claim 1, wherein said ball cradle portion is made of neoprene material.

7. The sports training apparatus of claim 1, wherein said tether line is attached to said belt by way of a spring-loaded clip extending said belt away from the user.

8. The sports training apparatus of claim 7, wherein said clip is swivel-mounted to said tether line to prevent said line from becoming twisted during use.

9. A sports training apparatus, comprising:

a belt with first and second ends adapted to encircle a waist of a user, said first and second ends including belt fasteners to removably secure said ends together;

a tether line extending from said belt to a ball holder;

said ball holder comprising a ball cradle portion and a locking arm portion;

said ball cradle portion comprising at least four cradle arms, each cradle arm having a first edge, a second edge, an end where said first and second edges meet, and a centerline, said first edge of each of said cradle arms beginning at said end of said cradle arm and extending curvilinearly away from said centerline of said arm, transitioning into a second edge of an adjacent arm, whereby a substantial surface area is provided between the intersection of the centerlines of each adjacent pair of arms and said transition of said first and second edges of said adjacent cradle arms; and said locking arm portion comprising at least four locking arms with first and second ends, each of said first ends of said locking arms being attached to each other, and each of said second ends being removably attachable to a corresponding end of one of said cradle arms.

10. The sports training apparatus of claim 9, wherein said ball holder is adjustable so as to accommodate and snugly adapt to a variety of ball sizes.

11. The sports training apparatus of claim 9, wherein said tether line is attached to said belt by way of a spring-loaded clip extending said belt away from the user.

12. The sports training apparatus of claim 9, wherein said tether line is made of an elastic material that lengthens under tensile forces on the line and thereafter contracts due to elastic resilience.

13. The sports training apparatus of claim 9, wherein said tether line is a flat braided elastic cord that stretches out at least about 200% in length.

14. The sports training apparatus of claim 9, wherein said clip is swivel-mounted to said tether line to prevent said line from becoming twisted during use.

* * * * *